US006019534A

United States Patent [19]

Heins

[11] Patent Number: 6,019,534

[45] Date of Patent: Feb. 1, 2000

[54] GRIPPING DEVICE FOR A HAND-HELD IMPLEMENT

[76] Inventor: Janice L. Heins, 20313 Yale, St. Claire Shores, Mich. 48081

[21] Appl. No.: 09/168,583

[22] Filed: Oct. 8, 1998

[51] Int. Cl.[7] ..... B43K 23/008

[52] U.S. Cl. ..... 401/6; 401/88

[58] Field of Search ..... 401/6, 88

[56] References Cited

U.S. PATENT DOCUMENTS

| | | | |
|---|---|---|---|
| 782,388 | 2/1905 | Goldsmith | 401/88 X |
| 1,868,441 | 7/1932 | Colfelt | 401/6 X |
| 4,167,347 | 9/1979 | Hoyle | 401/6 X |
| 4,601,598 | 7/1986 | Schwartz et al. | 401/6 |
| 4,617,697 | 10/1986 | David | 16/110 R |
| 4,832,604 | 5/1989 | Rusk | 434/166 |
| 4,911,569 | 3/1990 | Hashimoto et al. | 401/65 X |
| 4,932,800 | 6/1990 | Lin et al. | 401/6 |
| 4,934,024 | 6/1990 | Sexton, I | 16/111 R |
| 5,000,599 | 3/1991 | McCall et al. | 401/6 |
| 5,056,945 | 10/1991 | Klodt | 401/6 |
| 5,143,463 | 9/1992 | Pozil et al. | 401/6 |
| 5,320,438 | 6/1994 | Yang | 401/6 |
| 5,354,140 | 10/1994 | Diakoulas | 401/6 |
| 5,468,083 | 11/1995 | Chesar | 401/6 |
| 5,470,162 | 11/1995 | Rubin | 401/6 |
| 5,558,452 | 9/1996 | Oka et al. | 401/6 |

FOREIGN PATENT DOCUMENTS

| | | | |
|---|---|---|---|
| 2157175 | 5/1973 | Germany | 401/6 |

*Primary Examiner*—Steven A. Bratlie
*Attorney, Agent, or Firm*—Joseph N. Breaux

[57] ABSTRACT

A gripping device for a hand-held implement comprises a hollow cored tubing member having an internal diameter sized to fit over a grip portion of the hand-held implement. A plurality of annular ribs extend about exterior surface of the hollow cored tubing member. Each annular rib is formed with an internal gel filled chamber that is isolated from the gel filled chamber of adjacent annular ribs making it easier to hold and manipulate the hand-held implement while providing comfort for a hand of a person.

5 Claims, 2 Drawing Sheets

GRIPPING DEVICE FOR A HAND-HELD IMPLEMENT

TECHNICAL FIELD

The present invention relates to hand grips and more particularly to a gripping device for a hand-held implement. The gripping device for a hand-held implement comprises a hollow cored soft rubber tubing member having an internal diameter sized to fit over a grip portion of the hand-held implement and an exterior surface having a plurality of annular triangular shaped ribs thereabout, each formed with an internal gel filled chamber that is isolated from the gel filled chamber of adjacent annular triangular shaped ribs.

BACKGROUND ART

Numerous hand grips have been provided in prior art. For example, U.S. Pat. No. 4,601,598 to Schwartz et al.; U.S. Pat. No. 4,617,697 to David; U.S. Pat. No. 4,832,604 to Rusk; U.S. Pat. No. 4,932,800 to Lin et al.; U.S. Pat. No. 4,934,024 to Sexton, I; U.S. Pat. No. 5,056,945 to Klodt; U.S. Pat. No. 5,143,463 to Pozil et al.; U.S. Pat. No. 5,320,438 to Yang; U.S. Pat. No. 5,354,140 to Diakoulas; U.S. Pat. No. 5,468,083 to Chesar; U.S. Pat. No. 5,470,162 to Rubin and U.S. Pat. No. 5,558,452 to Oka et al. all are illustrative of such prior art. While these units may be suitable for the particular purpose to which they address, they would not be as suitable for the purposes of the present invention as heretofore described.

The Schwartz et al. U.S. Pat. No. 4,601,598 discloses a finger gripping device. A finger gripping device used as a removable attachment to a writing implement is formed as a one piece cylindrical body member made of flexible material. The body has an internal bore of uniform diameter so that it may be slid onto a writing implement. A plurality of circumferential ribs are axially spaced along the outside surface of the cylindrical body. The ribs are formed by closely spaced peaks and valleys.

The David U.S. Pat. No. 4,617,697 discloses a moldable handle adapter. A handle adapter for hand molding around an existing handle and constructed in a manner enabling the user to shape the external surface of the adapter to conform to the grip of the user's hand. The material to be molded is contained in a pouch having flexible walls and end closures. The size of the pouch is such that the total volume which it could contain is much larger than the volume of the moldable material therein. One half of the pouch has a cross-sectional area smaller than the cross-sectional area of the other half, whereby the smaller cross-section half of the pouch can be pushed inside the larger cross-section half of the pouch and the material therebetween becomes trapped between two concentrically positioned flexible walls. When the walls of the smaller half pouch are supported by a solid structure, the moldable material then envelops such structure. When pressure is applied externally preferentially at certain locations on the walls of the larger half pouch, the trapped moldable material has no way to escape and is forced to rearrange its shape to match the external contour imposed on the outer wall on which such pressure is being applied. The moldable material is then caused to harden while the pressure remains applied. This results in obtaining a molded external surface which thus matches the configuration of the means by which the pressure was externally applied.

The Rusk U.S. Pat. No. 4,832,604 discloses a writing aid. A device is disclosed for aiding in the gripping of an elongated hand-held writing instrument. The device includes a body having a central bore for receiving the hand-held writing instrument, and an exterior. The exterior includes a first gripping surface positioned for receiving the user's first finger; a second gripping surface positioned for receiving the user's second finger; and a third gripping surface positioned for receiving the user's third finger. At least one of the first, second and third gripping surfaces includes a surface indicia for providing a reference for placement of at least one of the user's fingers. The surface indicia comprises at least one character formed as a part of at least one of the first, second and third gripping surfaces. The character is disposed at a level different than the level of the area of the at least one surface adjacent to the character.

The Lin et al. U.S. Pat. No. 4,932,800 discloses a finger gripping device. A compressible finger gripping device for assembly with the surface portion of an article such as a writing instrument or a shaving instrument or the like. The device includes a substantially cylindrical body formed of a compressible, elastomeric material and defined by a substantially uniform OD and ID along the axial length of the body. A plurality of ribs arranged substantially parallel to the longitudinal axis of the body and substantially equidistantly spaced apart from each other are carried about the ID. The combination of the selected compressible material, the selected ID and OD dimensions of the body and the selected number, depth and thickness of the ribs cooperate and converge to provide a compressibility index (CI) valve for the device between about 1000 to about 18,000 gms/cm.

The Sexton,I U.S. Pat. No. 4,934,024 discloses a thermoplastic grip and method for making same. The grip is comprised of a deformable cover formed of a thermoplastic material which is stable and semi-rigid at normal ambient temperatures and is soft and deformable when heated in boiling water. The cover is attached to an implement handle heated and deformed to the shape required by a specific implement user. The method of forming the grip includes the steps of coating the implement handle with a cover material, heating the implement handle until the material has become softened, and grasping an implement handle while the cover is soft and deformable, thereby causing the cover to be molded to a user's specific shape. The high coefficient of friction and the moldability of the material results in a superior grip.

The Klodt U.S. Pat. No. 5,056,945 discloses a writing instrument grip. A grip for a writing instrument is disclosed which has a resilient plastic hollow tube with a plurality of flexible interior ribs extending radially inwardly from the tube and extending axially the length of the tube. A plurality of flexible exterior ribs extend radially outwardly from the tube and extend axially the length of the tube. The interior ribs are adapted to resiliently engage the shank of a writing instrument and the exterior ribs are preferably tapered and provide a resilient, cushioning grip to a writer. The radial thickness of the tube of the grip is small in comparison to the diameter of the tube so that the tube may be inverted or reversed so that the interior ribs extend radially outwardly and the exterior ribs extend radially inwardly. By reversing the grip, the resilient feel of the grip may be modified and the grip may be adapted to writing instruments of lesser diameter.

The Pozil et al. U.S. Pat. No. 5,143,463 discloses a writing aid. A writing aid is provided which facilitates the correct positioning of the hand of the user on a writing instrument and insures a relaxed, stress-free grip during the writing process. The writing aid comprises a small, generally pear-shaped body with a cylindrical hole running through the length thereof for insertion of the writing instrument, with the smaller end of the aid intended to be nearer the writing tip of the instrument. In a preferred embodiment the smaller end of the writing aid has a flat, truncated end surface. The larger end of the writing grip is bulbous and supports the first knuckle of the thumb and index finger to hold the fingers in extended position. First, second, and third concave depressions lie on lateral portions of the body, near the smaller end, spaced roughly 120 degrees apart, and are grasped by the thumb, index finger, and middle finger, respectfully, of a right-handed writer or the index finger, thumb, and middle finger, respectively, of a left-handed writer. The writing aid is preferably made of soft, resilient material, which provides a pliable surface and relaxes the fingers.

The Yang U.S. Pat. No. 5,320,438 discloses a grip for writing implements. This invention relates to a grip for writing implements and in particular to one including a tubular member having a spherical stock at an end, a swelling at an intermediate portion, a recess between the spherical stock and the swelling, and a converging end, the tubular member further having a longitudinal hole and a slot in communication with the longitudinal hole, the slot being formed with two aligned holes and two aligned recesses, and an adjusting member provided with two aligned pins and two aligned protuberances engageable with the aligned holes and the aligned recesses of the slot respectively, the adjusting member further having a rubber projection in an inner side, whereby the grip may facilitate the holding of a writing implement.

The Diakoulas U.S. Pat. No. 5,354,140 discloses a covered writing instrument, and process for making such writing instrument. A writing implement has a hollow housing having a front end and back end wrapped with at least one strand having a leading end and a trailing end, which strand ends are retained within the housing. The writing implement is thereby decorated, while also being durable, easy to use, and having an improved covered grip surface. The wrapping of at least one strand, or a plurality of strands, around the housing is accomplished in an inexpensive and simple method.

The Chesar U.S. Pat. No. 5,468,083 discloses an instrument hand grip. A writing instrument hand grip to facilitate gripping ease and comfort and to improve handwriting for people with a hand and finger dexterity disability. A pyramidal tetrahedron has a writing material detachably mounted to one or more of its apexes. Its faces may be concavely contoured and provided with friction enhancing surfaces.

The Rubin U.S. Pat. No. 5,470,162 discloses an ergonomic hand-held implement. A hand-held implement which is sufficiently small so that it does not extend beyond the hand of the user and has forward and side surfaces which are oriented so that the implement in use extends in a direction which is no further toward the thumb of the user than the index finger of the user. The forward and side surfaces can be provided with concave contours which engage the thumb and fingers of the user.

The Oka et al. U.S. Pat. No. 5,558,452 discloses a holder tube for a writing instrument. A holder tube for a writing instrument in which a plurality of rings having external faces subjected to different treatments are removably disposed in at least a grip portion of the holder tube. In another form of holder tube for a writing instrument, a plurality of rings having non-circular external faces are disposed in at least a grip portion of the holder tube in such a manner that the state of each of the rings differs from that of the adjacent one. In another form of holder tube for a writing instrument, at least three rings having different diameters are removably disposed in at least a grip portion of the holder tube. In a further form of holder tube for writing instrument, a ring or rings having longitudinally different external shapes are removably disposed in at least a grip portion of the holder tube.

GENERAL SUMMARY DISCUSSION OF INVENTION

The gripping device for a hand-held implement consists of a hollow cored soft rubber tubing member produced from soft rubber measuring approximately two to three inches in length and covered with a series of triangular shaped annular ribs made from rubber. Each triangular shaped angular rib is filled with a cushion of gel material allowing them to contour by pressure applied, while the hand-held implement is being held or manipulated. The gripping device for a hand-held implement may be produced in a variety of diameters and core hole sizes.

A primary object of the present invention is to provide a gripping device for a hand-held implement that will overcome the shortcomings of the prior art devices.

Another object is to provide a gripping device for a hand-held implement that is a hollow cored soft rubber tubing member having a plurality of annular pyramid shaped ribs thereabout filled with gel which is designed to slide onto a grip portion of the hand-held implement making it easier to hold and manipulate.

An additional object is to provide a gripping device for a hand-held implement that incorporates both an external textured exterior surface for a sure grip and a cushion of gel for comfort for a hand of a person.

A further object is to provide a gripping device for a hand-held implement that is simple and easy to use.

A still further object is to provide a gripping device for a hand-held implement that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

Similar reference characters denote corresponding features consistently throughout the attached drawings.

EXEMPLARY MODE FOR CARRYING OUT THE INVENTION

Figure 1:
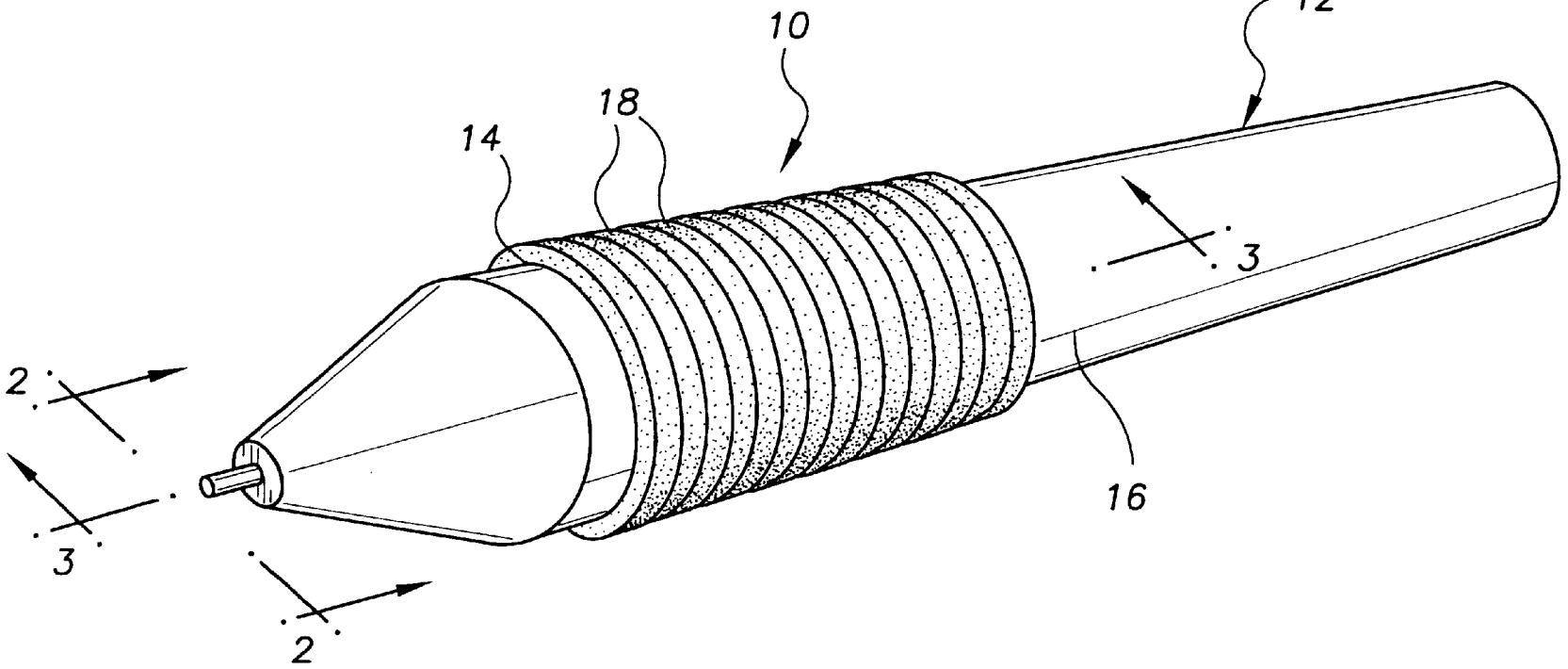
FIG. 1 is a perspective view of the present invention installed on a grip portion of a hand-held implement.
Figure 3:
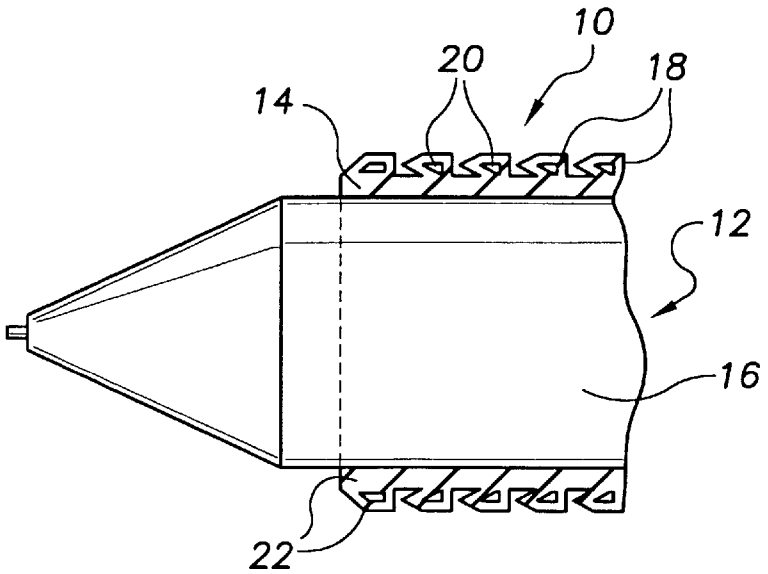
FIG. 3 is a cross sectional view taken along line 3—3 in FIG. 1 through the present invention, with a portion of the hand-held implement in elevation.
Figure 2:
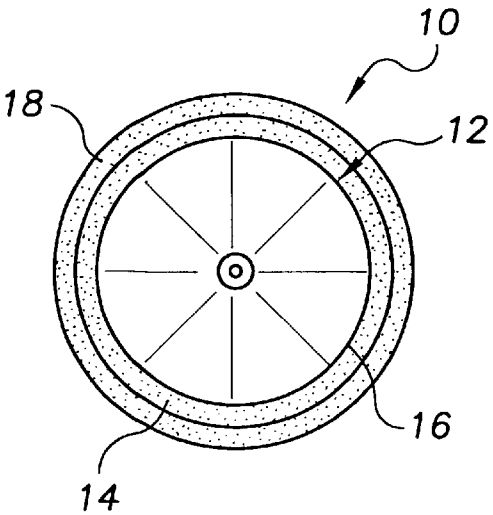
FIG. 2 is a front view taken in the direction of arrow 2 in FIG. 1.

Turning now descriptively to the drawings, in which similar reference characters denote similar elements throughout the several views, FIGS. 1 through 3 illustrate the various features of the present invention being a gripping device 10 for a hand-held implement 12 comprising a hollow cored tubing member 14 having an internal diameter sized to fit over a grip portion 16 of hand-held implement 12. A plurality of annular ribs 18 extend about exterior surface of hollow cored tubing member 14. Each annular rib 18 is formed with an internal gel filled chamber 20 that is isolated from gel filled chamber 20 of adjacent annular ribs 18, making it easier to hold an manipulate the hand-held implement 12 while providing comfort for a hand of a person.

The hollow cored tubing member 14 and annular ribs 18 are fabricated out of a flexible material 22, wherein flexible material 22 is soft rubber. Each annular rib 18 is triangular shaped in cross section to provide a textured exterior surface for a sure grip.

The hollow cored tubing member 14 measures approximately two to three inches in length to cover enough of the grip portion 16 of the hand-held implement 12 to properly fit into the hand of a person. The hollow cored tubing member 14 can be manufactured in a variety of different sized inside diameters, so as to fit over various sized grip portions 16 of hand-held implements 12. The hand-held implements can be pens, pencils and brushes.

It can be seen from the preceding description that in use, a person will select a gripping device 10 for a hand-held implement 12 of an appropriate size and diameter and then slide the gripping device 10 onto the grip portion 16 of the hand-held implement 12, such as a brush, pen or pencil. When painting or writing with the gripping device 10 on the hand-held implement 12, the person will rest the fingers against annular ribs 18, providing a comfortable, non-slip surface for the fingers.

It is noted that the embodiment of the gripping device for a hand-held implement described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A gripping device for a hand-held implement comprising:

a hollow cored tubing member having an internal diameter sized to fit over a grip portion of the hand-held implement; and a plurality of annular ribs extending about exterior surface of said hollow cored tubing member, each said annular rib formed with an internal gel filled chamber that is isolated from said gel filled chamber of adjacent annular ribs making it easier to hold and manipulate the hand-held implement while providing comfort for a hand of a person.

2. The griping device for a hand-held implement as recited in claim 1, wherein:

said hollow cored tubing member and said annular ribs are fabricated out of a flexible material.

3. The gripping device for a hand-held implement as recited in claim 2, wherein:

said flexible material is soft rubber.

4. The gripping device for a hand-held implement as recited in claim 1 wherein:

each said annular rib is triangular shaped in cross section to provide a textured exterior surface for a sure grip.

5. The gripping device for a hand-held implement as recited in claim 1 wherein:

said hollow cored tubing member measures approximately two to three inches in length to cover enough of the grip portion of the hand-held implement to properly fit into the hand of a person.

* * * * *